United States Patent [19]

Mooney et al.

[11] 3,967,872

[45] July 6, 1976

[54] CRADLE-TYPE GROUND LUG FOR CONDUIT

[75] Inventors: Thomas Mooney, Mount Sinai, N.Y.; Richard A. Bauer, Etters, Pa.

[73] Assignee: I-T-E Imperial Corporation, East Farmingdale, N.Y.

[22] Filed: Apr. 11, 1975

[21] Appl. No.: 567,377

[52] U.S. Cl. ..... 339/14 L; 174/78; 339/272 R

[51] Int. Cl.[2] ..... H01R 3/06

[58] Field of Search ..... 174/51, 78, 86; 339/14 L, 14 R, 272 R

[56] References Cited

UNITED STATES PATENTS

| | | | |
|---|---|---|---|
| 3,492,625 | 1/1970 | Bromberg | 339/14 R |
| 3,706,959 | 12/1972 | Norden | 339/14 R |

*Primary Examiner*—Roy Lake
*Assistant Examiner*—DeWalden W. Jones
*Attorney, Agent, or Firm*—Howard C. Miskin

[57] ABSTRACT

A cradle type wire grounding lug is secured to the periphery of a conduit fitting such as a bushing. The lug has a body with a generally C-shaped cross section for the wire clamping portion and has a mounting tang extending outwardly and angularly offset from the base of the C-shaped portion with a mounting screw opening in the tang for securing it to the periphery of the bushing. A binding screw extends down through the top flange of the C-section generally transverse to the ground wire receiving groove along the bottom flange of the C-section, which has an opening concentric to the binding screw opening. The mounting tang is offset about 30° from the plane which contains the base of the C-section.

10 Claims, 5 Drawing Figures

CRADLE-TYPE GROUND LUG FOR CONDUIT

BACKGROUND OF THE INVENTION

The present invention relates generally to improvements in grounding devices and it relates more particularly to an improved lay-in wire grounding lug for attachment to a conduit such as securement to the periphery of a bushing for mounting on a conduit.

Grounding lugs for conduit fittings such as is disclosed in the prior Browne U.S. Pat. No. 3,365,693, issued Jan. 23, 1968, are provided primarily for facilitating the grounding of conduit through a conduit bushing threaded onto the end of a conduit such as at a service box where the conduit passes through the wall of the box. This particular patent discloses the use of a grounding lug for laying in wire from the side so as not to require the wire to be cut and is generally adapted to be secured by a single screw to the periphery of a conduit bushing. The rear wall of the wire way and the top surface of the mounting tang are one and the same, so that the head of the securing screw oftentime is an obstruction in positioning the wire in the wire way. A clamping screw is provided for securing the wire within the lug.

Lugs of this type must be able to withstand heavy ground current flow which occasionally occurs under abnormal conditions such as because a phase to ground fault and the like, so that the lug must provide a low resistance connection from the conduit and service box to a substantially heavy ground wire. Oftentimes a single heavy ground wire is used for grounding a bank of conduits entering into a single box. Prior art devices of this type can accept a heavy ground wire, as long as the ground wire is perpendicular to the axis of the various conduits. However, if the ground wire is not perpendicular to the axis of the conduit, but generally parallel to the axis of any of the conduits, especially if the wire is used for a bank of conduits, the ground wire must be bent from the parallel position to the perpendicular position to be received with the lug. The heavy ground wire, usually made of solid copper conductor is difficult to bend, especially in cramped quarters, where many boxes or bushings on conduits are used, and difficult to avoid the obstruction of the mounting screw head. Also, since prior art grounding lug constructions of this type, in order to provide a low resistance connection from the lug to the conduit, provided the lug with teeth on the rear wall or base to prevent any rotation of the lug on the bushing, it was difficult, if not impossible, to rotate the lug in relation to the bushing to align the wire receiving portion with the wire. The prior art lugs possess numerous drawbacks and disadvantages, are often difficult to use in cramped quarters and otherwise leave much to be desired.

SUMMARY OF THE INVENTION

It is a principal object of the present invention to provide a rugged form of a grounding lug which is readily attachable to a fitting or bushing to which grounding wires of different sizes and character may be readily secured and held.

Another object of the present invention is to provide a grounding lug which allows the securing and electrical contact to a conduit to be remote from the clamping of the ground wire.

A still further object of the present invention is to provide an improved grounding lug for mounting on a bushing which can be aligned to receive the grounding wire at any angle with respect to the axis of the conduit and is easily and quickly mounted on the bushing.

Still another object of the present invention is to provide a grounding lug for mounting on a bushing which readily fits in tight spaces, easily receives the grounding wire without interference with the securing screw.

Still another object of the present invention is to provide an improved grounding lug for mounting on a bushing which substantially overcomes the disadvantages of the described prior constructions, and provides a structure characterized by its reliability, ruggedness, ease and convenience of use, simplicity and low cost and high versatility and adaptability.

The above and other objects of the present invention will become apparent from a reading of the following description taken in conjunction with the accompanying drawing, which illustrates a preferred embodiment thereof.

In a sense the present invention contemplates a grounding lug for mounting to and making electrical contact with an electrical conduit comprising a body having a generally C-shaped cross section configuration for receiving the ground wire, the axis of the ground wire being generally parallel to a plane passing through the base or rear wall of the "C" and a mounting tang extending from said rear wall and angularly offset from said plane, said tang containing an opening for receiving a mounting screw, and a binding screw extending down through the upper flange of said C-shaped portion for clamping engagement with the grounding wire seated along the lower flange of the C-section.

In the preferred form of the grounding lug, the tang is offset by about 30° to the axis of the seat for the ground wire so as to be adapted to easily attach to a bushing on a conduit in various positions for readily receiving the ground wire, and said mounting screw opening lying along generally the axis of said grounding wire in the C-section.

The improved ground lug is rugged, reliable, simple, inexpensive and easy and convenient to use.

DESCRIPTION OF THE PREFERRED EMBODIMENT

Figure 1:
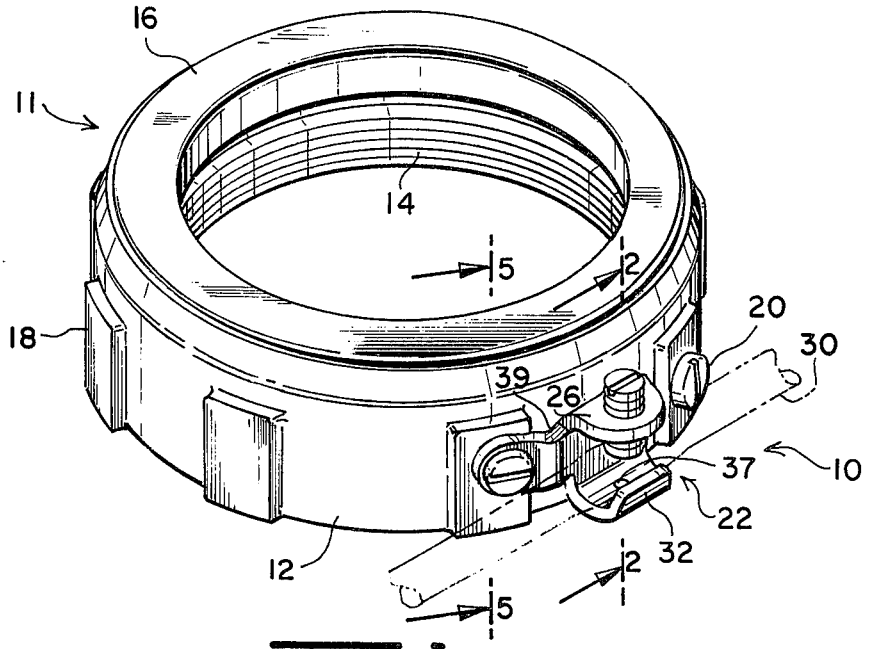
FIG. 1 is a perspective view of an insulated bushing to which is secured a grounding lug in accordance with the present invention and showing a grounding wire in phantom.

Referring now to the drawings which illustrate a preferred embodiment of the present invention as applied to a grounding lug, reference numeral 10 generally designates the combination of an insulated ground bushing 11 to which is affixed a grounding lug 22 in accordance with the present invention.

Figure 2:
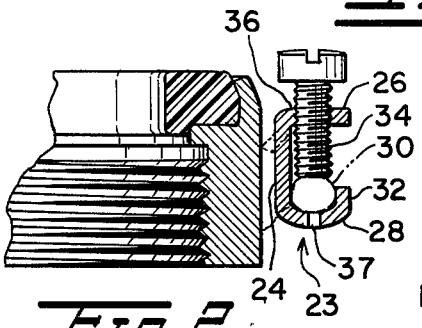
FIG. 2 is a sectional view of the grounding device and bushing taken along line 2—2 of FIG. 1.
Figure 4:
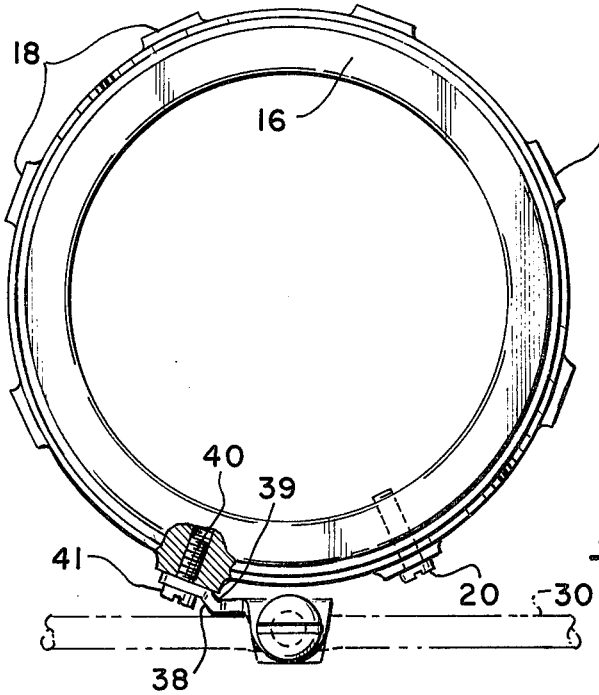
FIG. 4 is a top plan view, partially broken away, illustrating the present invention.
Figure 5:
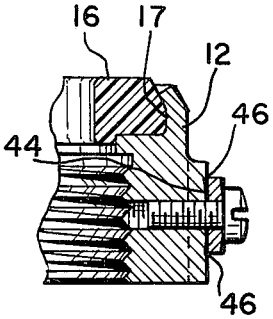
FIG. 5 is a sectional view of the grounding device taken along line 5—5 of FIG. 1.

The insulating bushing 11 illustrated, is of typical construction, including a metal ring 12, internally screw threaded such as at 14 to mate with the end of an electrical steel conduit, not shown and having a ring 16 of insulating material molded and snapped into the inner groove 17 of ring 12, as best shown in FIG. 2. Preferably the conduit, not shown, is metal and extends through a wall of a housing also not shown, which could hold a bank of such conduits, as is common in the art. Spaced about the outer periphery of ring 12 are a series of projections or protuberances 18 which are generally flat and aid in the tightening of bushing 11, on the conduit. Bushing 11 has a set screw 20 passing radially therethrough provided for tightening against the thread of the conduit to lock the bushing 11 against rotation. As shown in FIG. 4, set screw 20 passes through an opening in one of the projections 14.

Secured to the outer periphery of ring 12 is a grounding lug 22 having a body 23 of a generally C-shaped cross section, as seen best in FIG. 2. Body 23 has a rear wall or base 24 and has upper and lower flanged portions 26 and 28 respectively at opposite sides of base 24 for receiving between them a grounding wire 30, as seen best in FIGS. 1 and 2. Flange portion 28 which forms the lower wall of the lug preferably has a concave curve axially along its inner surface to form a seat for grounding wire 30, and has an upturned flange 32 at its outer or front edge, which holds wire 30 against escape or spreading action when the ground wire 30 is clamped and held in place along the bottom flange 28 by a screw 34 passing through a screw opening 36 in top flange 26. Screw opening 36 is aligned over wire 30 when positioned in the seat in flange 28. As illustrated, passing through the wire seat in lower flange 28 is an opening 37 coaxial to and smaller than opening 36 in upper flange 26. Opening 26 allows wire 30 to flow into it in response to the clamping pressure of screw 34 to insure a good electrical connection and resist movement of wire 30 during mounting of wire 30 in other lugs.

Figure 3:
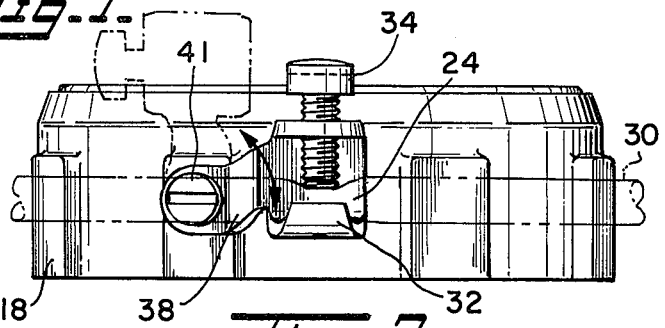
FIG. 3 is a front elevational view showing the grounding device.

Extending outwardly and axially offset from base 24 is a mounting tang 38. Adjacent the free end of mounting tang 38 is a screw opening, through which is received a securing or mounting screw 40 having a large head 41 to engage a corresponding screw seat in one of the projections 18, as seen best in FIG. 4. Mounting tang 38 is offset advantageously about 30° to the plane containing rear wall 24 and displaced longitudinally downwardly as well, so that the axis of the screw opening in tang 38 is aligned generally with the axis of grounding wire 30, as best shown in FIG. 3. Thus when ground wire 30 is in place it covers the mounting screw head 41 sufficiently to protect it against unauthorized tampering, even though wire 30 is spaced from the head of screw 40. Adjacent the base 24, tang 38 has a compound reverse bend, illustrated at 39, to allow body 23 to be offset from the securing screw head 41, but allowing body 23 to be close to the periphery of ring 12.

In view of the rearward compound angled curvature between the mounting tang 38 and the C-shaped body support 23, lug 22 can be rotated tangentially, as seen best in FIG. 3 with respect to the periphery of ring 12 and the axis of the conduit. The mounting tang 38 of lug 22 to be positioned relative to the axis of ground wire 30 in a variety of positions, so that the ground wire securing screw head 41, but allowing body 23 to be close to the periphery of ring 12.

In view of the rearward compound angled curvature between the mounting tang 38 and the C-shaped body support 23, lug 22 can be rotated tangentially, as seen best in FIG. 3, with respect to the periphery of ring 12 and the axis of the conduit. The mounting tang 38 of lug 22 can be positioned relative to the axis of ground wire 30 in a variety of positions, as illustrated in phantom in FIG. 3, so that the ground wire 30 can be readily passed through the opening in the front wall of body 23 and be positioned within the curved seat of flange 28 without the necessity of bending and twisting of the ground wire 30, so as to facilitate ease of connection. If the grounding wire 30 is required to be snaked through the grounding lug such as when banks of conduits must be grounded with a single ground wire, the head 41 of mounting screw 40 does not obstruct the movement of ground wire 30 through body 23. The compound bend in connector tang 38 provides clearance of the screw head 41 from the ground wire 30 and allows the ground lug 22 to hug the outer surface of the bushing 11 in any orientation, which creates a smaller turning radius of the bushing when rotated, which could be critical when used with sheet metal boxes in which dimensions are industry standard and oftentimes at a crowded position. Also, the tang allows the securing and electrical contact to be made remote from the clamping of the ground wire. Pressure applied by screw 34 on clamping wire 30 tends to spread the separated upper and lower flanges 26 and 28 exerting a force to arch rear wall 24. This arching tended to loosen the securing screw when the screw passed through the rear wall of the lug as in prior art devices.

While the present construction is particularly designed hardened to provide the desired resilience.

While there has been described and illustrated a preferred embodiment of the present invention, it is apparent that numerous alterations, omissions and additions may be made without departing from the spirit thereof.

What is claimed is:

1. A grounding lug to be secured to and to make contact with an electrical conducting surface comprising: a wire receiving body having a generally C-shaped cross section including a base superposed from said electrical conducting surface and upper and lower flanges extending transversely from opposite ends of said base, a binding screw extending down through the upper flange toward said lower flange and adapted to clamp the wire into engagement with the lower flange, and a mounting tang extending from one edge of said base between said flanges and angularly offset from a plane containing said base, said tang having a mounting screw opening therethrough transverse to the longitudinal axis of said tang and adjacent the end remote from said base.

2. A grounding lug according to claim 1 wherein said mounting screw opening in said tang lies within a plane passing through the axis of said wire in clamped position on said lower flange and transverse to the base of the body.

3. A grounding lug to be secured to and to make contact with an electrical conducting surface comprising: a wire receiving body having a generally C-shaped cross section including a base and upper and lower flanges extending transversely from opposite ends of said base, a binding screw extending down through the upper flange toward said lower flange and adapted to clamp the wire into engagement with the lower flange, and a mounting tang extending from said base between said flanges and angularly offset from a plane containing said base, said tang having a mounting screw opening therethrough transverse to the longitudinal axis of said tang and adjacent the end remote from said base, said tang's longitudinal axis being offset towards the lower flange from the axis of said base.

4. A grounding lug to be secured to and to make contact with an electrical conducting surface comprising: a wire receiving body having a generally C-shaped cross section including a base and upper and lower flanges extending transversely from opposite ends of said base, a binding screw extending down through the upper flange toward said lower flange and adapted to clamp the wire into engagement with the lower flange, and a mounting tang extending from said base between said flanges and angularly offset from a plane containing said base, said tang having a mounting screw opening therethrough transverse to the longitudinal axis of said tang and adjacent the end remote from said base, said tang contiguous to said base having a compound curve, with the curve closest to said base having a greater anular offset from said plane than the second curve.

5. A grounding lug according to claim 4 wherein said bottom flange has the surface facing said upper flange generally concave shaped to form a seat for the wire.

6. A grounding lug to be secured to and to make contact with an electrical conducting surface comprising: a wire receiving body having a generally C-shaped cross section including a base and upper and lower flanges extending transversely from opposite ends of said base, a binding screw extending down through the upper flange toward said lower flange and adapted to clamp the wire into engagement with the lower flange, and a mounting tang extending from said base between said flanges and angularly offset from a plane containing said base, said tang having a mounting screw opening therethrough transverse to the longitudinal axis of said tang and adjacent the end remote from said base, the rear surface of said tang being concave longitudinally.

7. A grounding lug to be secured to and to make contact with an electrical conducting surface comprising: a wire receiving body having a generally C-shaped cross section including a base and upper and lower flanges extending transversely from opposite ends of said base, a binding screw extending down through the upper flange toward said lower flange and adapted to clamp the wire into engagement with the lower flange, and a mounting tang extending from said base between said flanges and angularly offset from a plane containing said base, said tang having a mounting screw opening therethrough transverse to the longitudinal axis of said tang and adjacent the end remote from said base, said bottom flange having an opening therethrough concentric to said binding screw.

8. A grounding lug according to claim 4 wherein the lug is a stamping formed from resilient sheet metal, whereby the resilient flanges can spring load the clamping of a wire within the C-shaped body remote from securement to the electrical surface.

9. A grounding lug according to claim 4 wherein said electrical conducting surface is a bushing, said compound curve providing said body to be spaced from and following the general curvature of said bushing.

10. A grounding lug to be secured to and to make contact with an electrical conducting surface comprising: a wire receiving body having a generally C-shaped cross section including a base and upper and lower flanges extending transversely from opposite ends of said base, a binding screw extending down through the upper flange toward said lower flange and adapted to clamp the wire into engagement with the lower flange, and a mounting tang extending from said base between said flanges and angularly offset from a plane containing said base about 30°, said tang having a mounting screw opening therethrough transverse to the longitudinal axis of said tang and adjacent the end remote from said base.

* * * * *